US005273551A

United States Patent [19]

Brehme et al.

[11] Patent Number: 5,273,551

[45] Date of Patent: Dec. 28, 1993

[54] PROCESS FOR FIXING REACTIVE DYES ON CELLULOSIC TEXTILE MATERIAL: ENCLOSING MOISTENED DYED TEXTILE IN WATER-PROOF MATERIAL AND HEATING

[75] Inventors: Wolfgang Brehme, Weil am Rhein, Fed. Rep. of Germany; Rolf Hopf, Basel, Switzerland

[73] Assignee: Ciba-Geigy Corporation, Ardsley, N.Y.

[21] Appl. No.: 919,655

[22] Filed: Jul. 24, 1992

[30] Foreign Application Priority Data

Jul. 30, 1991 [CH] Switzerland ..... 2280/91

[51] Int. Cl.[5] ..... D06P 3/66; D06P 5/00

[52] U.S. Cl. ..... 8/500; 8/543; 8/549; 8/918

[58] Field of Search ..... 8/543, 549, 500

[56] References Cited

FOREIGN PATENT DOCUMENTS 0416888 3/1991 European Pat. Off. .

*Primary Examiner*—A. Lionel Clingman

*Attorney, Agent, or Firm*—Marla J. Mathias; George R. Dohmann

[57] ABSTRACT

The invention relates to a process for fixing reactive dyes on cellulosic textile material and to apparatus for carrying out said process.

The process comprises wetting the dried fibre material, which has been printed with reactive dyes, with water, covering the printed material with water-impermeable material and subjecting it to a heat treatment. The fixation can be carried out with advantage using minor amounts of urea, but preferably without urea, to give prints of good quality.

13 Claims, No Drawings

PROCESS FOR FIXING REACTIVE DYES ON CELLULOSIC TEXTILE MATERIAL: ENCLOSING MOISTENED DYED TEXTILE IN WATER-PROOF MATERIAL AND HEATING

The present invention relates to a process for fixing reactive dyes on cellulosic textile material and to apparatus for carrying out said process.

To print cellulosic textile material with reactive dyes it is customary to use substantial amounts of nitrogen-containing compounds, especially urea. The function of the urea is in particular to help ensure an adequate fixation of the reactive dyes. But aside from its very useful properties for printing and fixing with reactive dyes, urea is a major pollution factor in the wastewaters on account of its nitrogen-containing degradation products.

There has therefore been no lack of efforts to reduce the amount of urea or to eliminate it completely by, for example, wetting the printed material with water before the fixation process and then carrying out fixation with steam. This process, however, only gives satisfactory results if it is possible to apply the water such that the moisture equilibrium between water/fabric is as close as possible to the maximum moisture content of the respective fabric and that this maximum value can be kept as far as possible constant during the fixation process. In practice, adjustment of the optimum moisture content during fixation is a procedure which it is difficult to regulate.

A process has now been found which makes it possible to keep the moisture content of the printed material at the maximum value and constant by wetting the printed material with water and carrying out fixation such that the material is sealed steam-proof Specifically, the invention relates to a process for fixing reactive dyes on cellulosic textile material, which comprises a) wetting the printed, dried material with water,
b) covering the textile material with a water-impermeable material, and
c) subjecting the material to a heat treatment to effect fixation.

The invention also relates to the printed material fixed by the novel process. The invention further relates to apparatus for carrying out the novel process.

The dyes used in the process of this invention are the reactive dyes conventionally used for dyeing or printing cellulosic textile materials.

Reactive dyes will be understood as meaning per se known dyes which form a covalent chemical bond with cellulose, typically those listed under "Reactive Dyes" in the Colour Index, Vol. 3 (3rd edition 1971) pages 2391-3560 and Vol. 6 (revised edition, 1975) on pages 6268-6345. Reactive dyes which are particularly suitable for the novel process are those which contain a monohalotriazinyl group. The monohalotriazinyl group is in this context a monofluorotriazinyl, monobromotriazinyl or, preferably, monochlorotriazinyl group.

Further preferred reactive dyes are those which contain one or more vinylsulfonyl groups as reactive group.

The amount of dye will normally depend on the desired colour strength and is conveniently from 0.1 to 300 g/kg of printing ink, preferably 0.1 to 100 g/kg and, most preferably, 5 to 60 g/kg of printing ink.

When using reactive dyes, the printing inks will normally contain fixing alkalies. Alkalies used for fixing the reactive dyes are typically sodium carbonate, sodium hydrogencarbonate, sodium hydroxide, disodium phosphate, trisodium phosphate, borax, aqueous ammonia, or alkali donors such as sodium trichloroacetate or sodium formate. A mixture of sodium silicate and a 25% aqueous solution of sodium carbonate may also be used as alkali.

The alkali-containing printing inks normally have a pH in the range from 7.5 to 13.2, preferably from 8.5 to 11.5.

In addition to containing the dyes, the aqueous print pastes used for the novel process also contain a thickener, preferably of natural origin, especially sodium alginate by itself or in admixture with modified cellulose, preferably with at most 20 to 25% by weight of carboxymethyl cellulose. If desired, the print pastes may additionally contain preservatives, sequestering agents, emulsifiers, water-insoluble solvents, oxidising agents and deaerating agents.

The novel process is suitable for fixing dyes on textile materials which consist of, or contain, cellulose. The textile materials are preferably flat textile structures such as nonwovens, felts, carpets, woven goods and, preferably, knitted goods. The novel process is suitable for fibre materials which have been treated with aqueous sodium hydroxide, preferably for cellulosic material and regenerated cellulose, such as viscose rayon.

For printing the fibre materials, the print paste is applied direct to the whole or part of the surface, conveniently using printing machines of conventional make, for example rotogravure, rotary screen printing and surface screen printing machines.

After it has been printed in the temperature range up to 150° C., the fibre material is preferably dried at 800°-120° C. Before fixing the dyes, the fibre material is uniformly wetted with water on the face, on the back or on both sides. This wetting may be effected in different ways, conveniently by direct or indirect methods of application. The fibre material can be wetted directly by spraying with a commercial atomiser, by roller systems, with screens or by applying water in the form of foam, or by rotary wetting, the principle of which is described in detail in Textilpraxis International, 1119 (1987). The amount of water applied is in the range from 5 to 50% by weight, preferably from 10 to 40% by weight, based on the printed, dry fibre material.

The water used for wetting can be processed by ion exchange resins or distillation. If desired, wetting agents or thickeners can be added to the water. In addition, the water may also contain alkali.

Alkali-containing water is used especially if the print paste used for printing does not contain alkali and alkali is needed to fix the dyes.

The printed and wetted fibre material is thereafter subjected to a heat treatment as claimed in claim 1.

The fixation process of this invention can be carried out continuously or batchwise. The material, normally a web of fabric, can be covered on both sides by a water-impermeable material to form a sandwich and in this form subjected to the heat treatment; or the fabric lies with one side on a water-impermeable heating element and is covered with a water-impermeable material on the side facing away from the heating element. In this latter case, the heating element acts as a single-sided—or if a press is used, if desired also as a two-sided—steam blocker.

An essential feature is that the textile material is sealed water-tight and steam-proof for the duration of the thermofixation. In the case of planar fabric it will sufficient to cover the face and the back of the fibre material with a water-tight and steam-proof blocking coat.

Suitable steam-proof materials are thin, heat- and sublimation-resistant sheets which do not react chemically with the fibre material and the print paste applied thereto as well as the wetting liquor. These sheets serve to seal the printed fibre material snugly and hence to prevent the steam from volatilising. Different materials are suitable for this purpose. For the process of this invention it is preferred to use polyester sheets. Sheets of teflon, metal or heat-resistant rubber can also be used to seal the fibre material.

The heat treatment is carried out continuously on a suitably modified colander or in a heated tunnel; or batchwise in a heated, sealed chamber or on a press, conveniently a transfer ironing press, for about 30 seconds to 20 minutes, preferably for 5 to 10 minutes, under a pressure of about 0.2 to 2 bar. The fixation temperature is in the range from 90° to 150° C., preferably from 100° to 110° C.

Following the heat treatment the cellulosic textile material is given a conventional washing-off to remove unfixed dye. This is done by treating the substrate at 20° C. to boiling temperature with water, preferably soft water. Then the material is dried in conventional manner.

The novel process gives level and tinctorially strong prints which permit the use of smaller amounts of urea than in conventional processes while the print quality remains the same.

In a particularly preferred embodiment of the novel process, the fixation can also be carried out entirely without urea.

The heat required for the fixation can be applied to the material in the form of contact, ambient or radiation heat.

Fixation by contact heat can be effected in simple manner by availing of apparatus already in use for the continuous or batchwise fixation.

In the continuous process, the heat required for fixation can be supplied as contact heat from a colander. The fibre material is covered on one side or on both sides with the water-impermeable sheet prior to contact with the colander and passed over the colander. If the fibre material is covered on one side with the sheet, the surface of the colander acts as second blocking layer.

In a preferred embodiment of the continuous process, a continuous sheet of water-impermeable material is laid or pressed on to the calander and the fibre material to be fixed is drawn in between this sheet and the calander. The colander modified with the water-impermeable sheet likewise constitutes an object of the invention.

In the batchwise process the heat required for fixation can be supplied as contact heat by a press, typically a transfer ironing press. No, or only insignificant, modifications of the press are necessary for carrying out the novel process. Prior to fixation the fibre material can be covered on both sides by the sheet of water-impermeable material to form a sandwich and then put into the press. However, it is also possible to cover one or both contact sides of the press with water-impermeable material and in this manner to carry out the fixation. In this case the fibre material must be covered either only on one side with the sheet of water-impermeable material or, if the press is water-impermeable on both sides, the suitably wetted fibre material is also put into press directly.

The press provided with one or two water-impermeable contact surfaces likewise constitutes an object of the invention.

In addition to the contact heat, the heat required for the novel fixation process can also be supplied as ambient heat. Thus the water-tight sealed fibre material can be passed through a tunnel or sealed in a heated room during the time required for the fixation.

The thermofixation of the water-tight sealed fibre material can also be carried out by radiation energy (infra-red radiation, UV radiation or with microwaves). The water-tight sealed fibre material is either passed continuously through a tunnel heated by radiation energy or is sealed batchwise in a heated chamber during the time required for the fixation.

The following Examples illustrate the invention.

EXAMPLE 1

A four-colour pattern is printed on bleached, mercerised cotton fabric. The respective print pastes contain 40 g/kg of a commercial dye formulation of formula

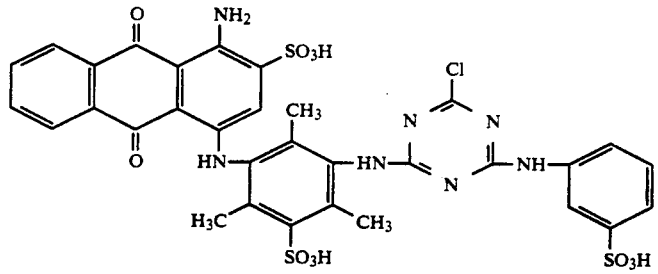

(I)

25 g/kg of a commercial dye formulation of formula

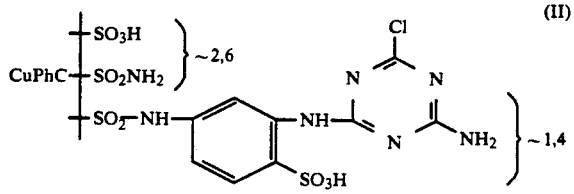

(II)

and 40 g/kg of a commercial granular mixture of dyes of formulae

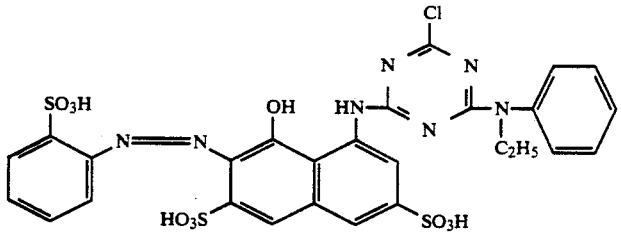

(IIIa)

and

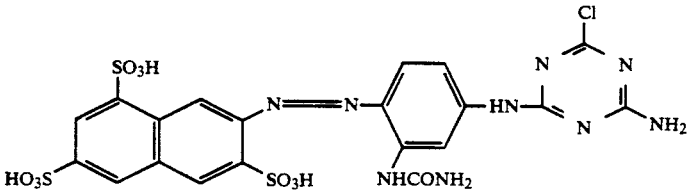

(IIIb)

and 55 g/kg of a commercial granular mixture of dyes of formulae

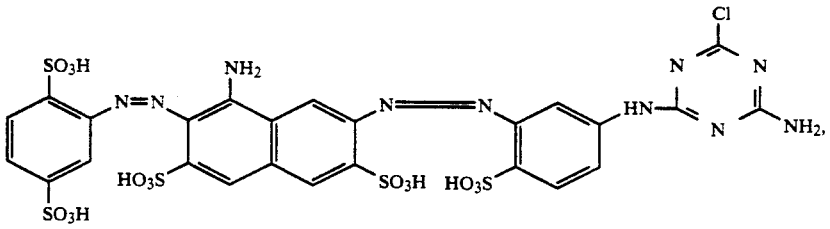

(IVa)

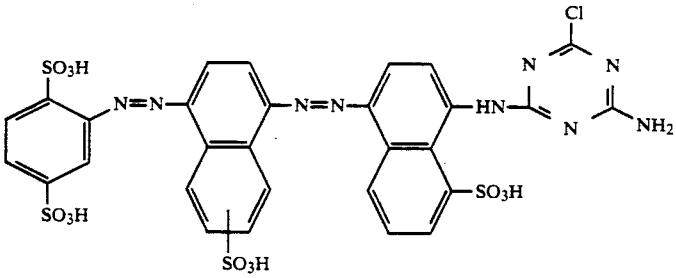

(IVb)

and of formula (IIIb).

The above reactive dyes are blended with the following chemicals to a print paste. The final weight of each of the print pastes is 1000 g. The print paste contains:

500 g/kg of a 6% solution of sodium alginate 10 g/kg of sodium m-nitrobenzenesulfonate 120 g/kg of a 25% solution of $Na_2CO_3$, and water to make up 1000 g.

The patterned print is given an intermediate drying for 2 minutes at 120° C.

Using a minimum applicator, the reverse side of the printed material is wetted with 12% water, based on the weight of the material.

The wetted material is sandwiched snugly between two polyester sheets and treated for 8 minutes at 105° C. on on ironing press to fix the print.

The fixed print is given a conventional washing-off with cold and hot water and then dried at 90°-100° C., to give a tinctorially strong reactive print.

What is claimed is:

1. A process for fixing reactive dyes on cellulosic textile material, which comprises a) wetting the printed, dried material with water, b) covering the textile material with a water-impermeable material said water-impermeable material being selected from the group consisting of a polyester sheet, a teflon sheet and a heat-resistant rubber sheet, and c) subjecting the material to a heat treatment to effect fixation.

2. A process according to claim 1, wherein fixation is carried out without urea.

3. A process according to claim 1, wherein the heat treatment is carried out with contact heat.

4. A process according to claim 1, wherein the heat treatment is carried out with ambient heat.

5. A process according to claim 1, wherein the heat treatment is carried out with radiation heat.

6. A process according to claim 1, wherein the material is covered on both sides by the water-impermeable material.

7. A process according to claim 3, wherein a calander is used as heating element.

8. A process according to claim 7, wherein the fibre material is covered with a water-impermeable material on the side facing away from the calander.

9. A process according to claim 3, wherein a press is used as heating element.

10. A process according to claim 9, wherein one or both contact surfaces of the press are provided with water-impermeable material.

11. A process according to claim 1, wherein the reactive dye to be fixed is a dye which contains a monohalotriazinyl radical.

12. A process according to claim 1, wherein the reactive dye to be fixed is a dye which contains one or more vinylsulfonyl groups.

13. The fibre material treated by a process as claimed in claim 1.

* * * * *